United States Patent [19]

Johnson et al.

[11] Patent Number: 4,982,829

[45] Date of Patent: Jan. 8, 1991

[54] FLEXIBLE ESCALATOR HANDRAIL

[75] Inventors: Gerald E. Johnson, Farmington; Dat Nguyen, New Britain, both of Conn.

[73] Assignee: Otis Elevator Company, Farmington, Conn.

[21] Appl. No.: 460,800

[22] Filed: Jan. 4, 1990

[51] Int. Cl.[5] ..... B66B 23/24

[52] U.S. Cl. ..... 198/337

[58] Field of Search ..... 198/335, 337, 847, 821

[56] References Cited

U.S. PATENT DOCUMENTS

| | | | |
|---|---|---|---|
| 4,852,713 | 8/1989 | Tatai et al. | 198/337 |
| 4,932,512 | 6/1990 | Rivera | 198/337 |
| 4,934,506 | 6/1990 | Rivera | 198/335 |

FOREIGN PATENT DOCUMENTS

| | | | |
|---|---|---|---|
| 3602945 | 8/1987 | Fed. Rep. of Germany | 198/337 |

*Primary Examiner*—Joseph E. Valenza

*Attorney, Agent, or Firm*—William W. Jones

[57] ABSTRACT

The escalator handrail is provided with increased lateral flexibility by forming it with a guide rail spanning web which is elliptical in cross-section. Adjacent internal reinforcement cables are positioned in slightly vertically offset horiozntal planes so as not to unduly hinder lateral flexure of the handrail. The handrail's increased flexibility results in less frictional drag on the guide rail, and adapts the handrail for use with helical escalator assemblies and provides improved performance in conventional rectilinear escalators as well.

4 Claims, 1 Drawing Sheet

FLEXIBLE ESCALATOR HANDRAIL

DESCRIPTION

1. Technical Field

This invention relates to escalator handrails and more particularly to escalator handrails having improved lateral flexibility.

2. Background Art

Conventional escalator and moving walkway handrails, when viewed in plan, follow a rectilinear path of movement, and thus require minimal lateral or horizontal flexibility. The degree of lateral flexibility required of a conventional escalator handrail is only that which will allow it to cope with minor deviations in the rectilinearity of the guide rail over which it slides. The flexibility required in the vertical plane in order to allow the handrail to traverse the newels is provided by the C-shape of the handrail, and its rubber composition. Since a conventional escalator handrail requires minimal lateral flexure, internal reinforcing cables will typically be aligned in a common horizontal plane or planes so as to actually increase the lateral stiffness of the handrail. While the aforesaid laterally stiff handrails are generally satisfactory for conventional rectilinear escalators and moving walkways, they are not desirable for use in a curved or helical escalator. The requirement that the handrail follow a curved path of travel in a curved escalator renders the laterally stiff conventional handrail ill suited for the task. If a conventional handrail is used on a curved escalator, even when the radius or radii of curvature are quite large, the stiffness of the handrail will cause difficulty in mounting on the guide rail, and will cause excessive drag which requires high driving forces and results in inordinate wear on the handrail and guide rail.

DISCLOSURE OF THE INVENTION

The handrail of this invention is provided with increased lateral flexibility so as to allow it to travel over a curved or rectilinear (in plan) guide rail with minimal drag and wear. The handrail can be internally strengthened by reinforcing tension cables without impairing its transverse flexibility. The handrail is made from a conventional rubber composition, or the like, and assumes generally the conventional C-shaped cross section. The cross section of the handrail of this invention is, however, modified by imparting a flexure-enhancing radius of curvature to the portion of the handrail which spans the guide rail, i.e., the portion of the handrail on which one normally rests one's hand. The top web of the handrail, instead of being flat as is a conventional handrail, is rounded. The internal reinforcing cables are disposed with their axes along an imaginary curved transverse line internally of the top web of the handrail. By vertically offsetting the axis of each reinforcing cable from the axes of the cables on either side of it, the cable array does not unduly resist lateral flexure of the handrail.

It is therefore an object of this invention to provide an escalator handrail having an improved facility for lateral flexure.

It is an additional object of this invention to provide an escalator handrail of the character described suitable for use in a helical escalator assembly.

It is a further object of this invention to provide an escalator handrail of the character described having internal reinforcing cables arranged so as not to hinder lateral flexure of the handrail.

BRIEF DESCRIPTION OF THE DRAWINGS

These and other objects and advantages of the invention will become more readily apparent from the following detailed description of a preferred embodiment thereof when taken in conjunction with the accompanying drawings in which.

BEST MODE FOR CARRYING OUT THE INVENTION

Figure 1:
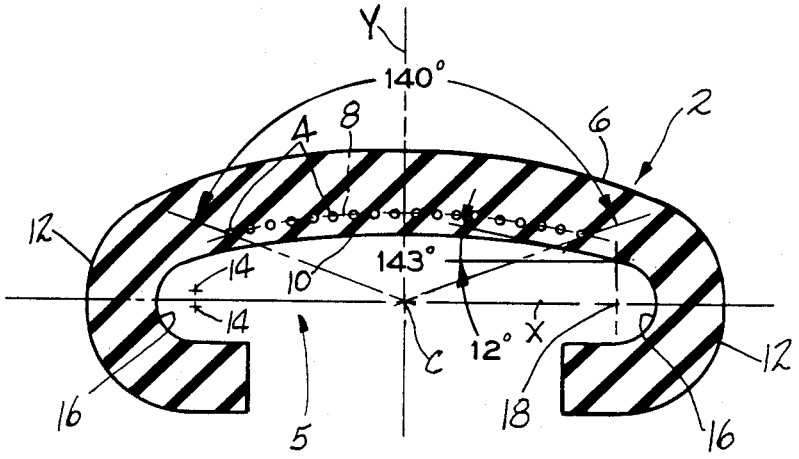
FIG. 1 is a transverse sectional view of an escalator handrail formed in accordance with this invention.
Figure 2:
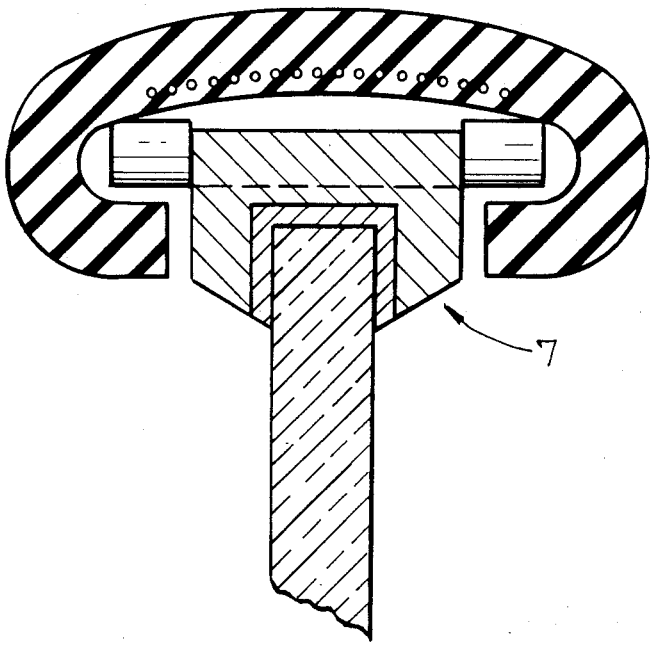
FIG. 2 is a similar view showing the handrail mounted on a guide rail.

The handrail is denoted generally by the numeral 2 and is typically formed from an elastomeric material such as rubber, neo-rubber or the like. The handrail is provided with a plurality of internal axially extending reinforcing strands 4 of steel, carbon fiber, or the like. The upper surface 6 of the handrail 2 has an elliptical contour. The ellipse defining the portion 6 of the handrail 2 is struck from center point C located in a pocket 5 formed by the handrail 2. The guide rail 7 is located in the pocket 5. The center point C is defined by the intersection of horizontal and vertical axes X and Y, respectively. The elliptical surface 6 extends through an arc of about 140°. about the center point C. The axes of the reinforcing strands 4 lie along an elliptical line 8 which extends through an arc of about 140° about the center point C. The inner surface 10 of the handrail 2 is also elliptical through an arc of about 143° about the center point C. The aforesaid elliptical surfaces and strand line are all generated about the center point C. The outer sides 12 are circularly configured and defined by arcs generated from points 14 (shown only on the left hand side of the drawing for clarity), and the inner sides 16 are circularly configured and defined by arcs generated about points 18 (only one of which is shown on the right hand side of the drawing for clarity). Flat surfaces connect the circular surfaces 12 and flat surfaces connect the circular surfaces 16 with the ends of the elliptical surface 10 so as to smoothly blend the various curved surfaces together.

As previously noted, the elliptical surfaces are all generated about the center point C, and are defined by the equation $$\frac{x^2}{a^2} + \frac{y^2}{b^2} - 1 = 0$$

where a equals the maximum value on the X axis, and where b equals the maximum value on the Y axis. Both a and b are preselected based on the desired size of the handrail 2. In the instant case, the selected a value lies beyond the sides 12 of the handrail due to the circular configuration of the sides 12. Once a and b are selected, x or y may be calculated from the formula. For example, the formula will calculate any y point for each selected x point. This procedure is followed to generate all three of the elliptical planes in the handrail 2.

It will be readily appreciated that the moment of inertia around the Y axis is less from the elliptical configuration than from the flat configuration. The elliptical configuration when subjected to a bending moment around the Y axis allows a responsive vertical movement of the handrail. The elliptical arrangement of the reinforcing strands allows movement of the latter within the handrail so that lateral bending of the handrail is not entirely restricted since each reinforcing strand is in a slightly different horizontal plane than those on either side of it. The handrail thus adjusts more easily to a changing path of travel then does a conventional handrail.

Since many changes and variations of the disclosed embodiment of the invention may be made without departing from the inventive concept, it is not intended to limit the invention otherwise than as required by the appended claims.

What is claimed is:

1. A generally C-shaped escalator handrail made from an elastomeric material and operable to slide over a fixed guide rail, said handrail comprising a web portion overlying the guide rail, said web portion having: an outer surface remote from the guide rail and formed with a medial elliptical part; an inner surface facing the guide rail and having a medial elliptical part; and a plurality of longitudinal reinforcing strands in said web portion between said inner and outer surfaces, said strands having their axes disposed along an imaginary transverse elliptical line with the outer and inner elliptical surface parts and the elliptical positioning of said reinforcing strand axes imparting increased lateral flexibility to the handrail.

2. The handrail of claim 1 wherein said inner and outer elliptical surface parts and said imaginary elliptical line are all generated from a common center point.

3. The handrail of claim 2 wherein said center point is disposed in a guide rail-receiving pocket part of the handrail, midway between opposed outermost side surfaces of the handrail.

4. The handrail of claim 2 wherein said imaginary elliptical line is closer to said inner elliptical surface part than it is to said outer elliptical surface part.

* * * * *